US008550014B1

(12) United States Patent
Mariani

(10) Patent No.: US 8,550,014 B1
(45) Date of Patent: Oct. 8, 2013

(54) PERFECT PEDESTAL PLATE SYSTEM

(71) Applicant: Gwen Mariani, Waterford, CT (US)

(72) Inventor: Gwen Mariani, Waterford, CT (US)

( * ) Notice: Subject to any disclaimer, the term of this patent is extended or adjusted under 35 U.S.C. 154(b) by 0 days.

(21) Appl. No.: 13/716,832

(22) Filed: Dec. 17, 2012

Related U.S. Application Data

(60) Provisional application No. 61/584,341, filed on Jan. 9, 2012.

(51) Int. Cl.
*A47B 13/02* (2006.01)

(52) U.S. Cl.
USPC ..... 108/150; 108/12

(58) Field of Classification Search
USPC ..... 108/150, 11, 12, 13, 157.1, 159.11, 108/158, 158.11, 158.12, 158.13; 248/188
See application file for complete search history.

(56) References Cited

U.S. PATENT DOCUMENTS

| | | | | | |
|---|---|---|---|---|---|
| 1,733,001 | A | * | 10/1929 | Binger | 108/92 |
| 1,903,631 | A | * | 4/1933 | Morrison | 108/150 |
| 2,560,659 | A | * | 7/1951 | Payeur | 108/139 |
| 2,748,954 | A | * | 6/1956 | Murren | 108/91 |
| 3,230,909 | A | * | 1/1966 | Watson | 108/150 |
| 3,230,910 | A | * | 1/1966 | Olssen | 297/461 |
| D211,532 | S | | 6/1968 | Ashton | |
| 3,850,117 | A | * | 11/1974 | Martinelli | 108/150 |
| 3,951,079 | A | | 4/1976 | Tolleson | |
| 4,328,942 | A | | 5/1982 | Birnbaum | |
| 5,060,820 | A | | 10/1991 | Boerner | |
| 5,285,987 | A | | 2/1994 | Gonzalez | |
| 5,638,758 | A | * | 6/1997 | Carr | 108/50.02 |
| D380,350 | S | | 7/1997 | Tortorella et al. | |
| D401,810 | S | | 12/1998 | Swift | |
| 6,467,843 | B1 | * | 10/2002 | Rossborough | 297/344.18 |
| 6,484,649 | B1 | * | 11/2002 | Wang | 108/158 |
| D507,933 | S | | 8/2005 | Carmichael | |
| D538,450 | S | | 3/2007 | Adams et al. | |
| D567,585 | S | | 4/2008 | Kovach | |
| D577,962 | S | | 10/2008 | Bauer et al. | |
| D636,637 | S | | 4/2011 | Lupkes et al. | |
| D658,011 | S | | 4/2012 | Goode et al. | |
| 2004/0003760 | A1 | | 1/2004 | O'Connell Cooper et al. | |
| 2006/0021549 | A1 | * | 2/2006 | Theinert | 108/91 |
| 2008/0061020 | A1 | | 3/2008 | Kaisler | |
| 2008/0197087 | A1 | | 8/2008 | Hunter | |
| 2010/0224642 | A1 | | 9/2010 | Beeson et al. | |
| 2011/0220767 | A1 | | 9/2011 | Stewart et al. | |

* cited by examiner

*Primary Examiner* — Jose V Chen
(74) *Attorney, Agent, or Firm* — Goldstein Law Offices, P.C.

(57) ABSTRACT

A system for setting a table that displays a plurality of items on different elevated levels using invertible stacking members, the stacking members having two forms, plate and pedestal, that form a plurality of different configurations. A pedestal base member engages a plate member in a pedestal plate configuration and inverts into a vase configuration. The pedestal base member converts into a candle holder and selectively engages the plate member, the plate member selectively displaying a decorative item surrounding the base member, the combination forming a centerpiece. The pedestal base member engages the plate member, forming a stackable pair, stacking with other pairs, another base member or another plate member. The pedestal base members selectively stack with each other. The plate members each have an interlocking rim that locks with the plate above and the plate below, forming a compact stack on a buffet table.

8 Claims, 11 Drawing Sheets

PERFECT PEDESTAL PLATE SYSTEM

CROSS-REFERENCE TO RELATED APPLICATIONS

This application is a nonprovisional utility application of the provisional patent application Ser. No. 61/584,341 filed in the United States Patent Office on Jan. 9, 2012 and claims the priority thereof and is expressly incorporated herein by reference in its entirety.

TECHNICAL FIELD

The present disclosure relates generally to a system of tableware. More particularly, the present disclosure relates to a system of invertible tableware for displaying and serving.

BACKGROUND

Hosts and hostesses wish to present an attractive table to guests when serving buffet style or at table. How the food is displayed and presented increases the appeal of the dish, making it tempting and irresistible.

Hosts enjoy adding decorative touches such as a floral display, candles and creative centerpieces. When all of the dishes, displays, candles and centerpieces are placed directly on the table, sitting flat on the table surface, the table landscape is crowded and unattractive. The surface area of the table limits the display area. If a host needs to fit everything on a table by elevating one or more items, he or she may have to go purchase one or more specialty items, which may be time consuming and expensive. If a host does own several display devices, matching the devices and finding storage for different size pieces between events is difficult. These devices take up a lot of space in the cabinet and not leaving much room for regular tableware.

Presenting dishes of food on one level at a buffet makes it difficult for the diner to reach over one series of plates to reach the desired dish, take a portion and then place it on his or her plate without spilling the food.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a system for setting a table that displays an item on an elevated level. Accordingly, an aspect of an example embodiment in the present disclosure provides a pedestal base member that engages a plate member in a first configuration, forming a pedestal plate.

Another aspect of an example embodiment in the present disclosure is to provide a system for setting a table that has a member that operates in a first configuration and operates when inverted in a second configuration. Accordingly, the present disclosure provides a pedestal base that operates as a vase in a first configuration and operates inverted as candle holder in a second configuration.

A further aspect of an example embodiment in the present disclosure is to provide a system for setting a table that stacks to form a display on a plurality of levels. Accordingly, the present disclosure provides a plurality of engaged pairs, a pair having pedestal base member engaged with a plate member, the pairs stacking to form a tiered pedestal plate.

Yet another aspect of an example embodiment in the present disclosure is to provide a system for setting a table that compactly stacks on a buffet table. Accordingly, the present disclosure provides a system having a plurality of plate members, each with an interlocking rim that locks with a plate above and a plate below, forming a compact stack on a buffet table.

The present disclosure describes a system for setting a table that displays a plurality of items on different elevated levels using invertible stacking members, the stacking members having two forms, plate and pedestal, that form a plurality of different configurations. A pedestal base member engages a plate member in a pedestal plate configuration and inverts into a vase configuration. The pedestal base member converts into a candle holder and selectively engages the plate member, the plate member selectively displaying a decorative item surrounding the base member, the combination forming a centerpiece. The pedestal base member engages the plate member, forming a stackable pair, stacking with other pairs, another base member or another plate member. The pedestal base members selectively stack with each other. The plate members each have an interlocking rim that locks with the plate above and the plate below, forming a compact stack on a buffet table.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
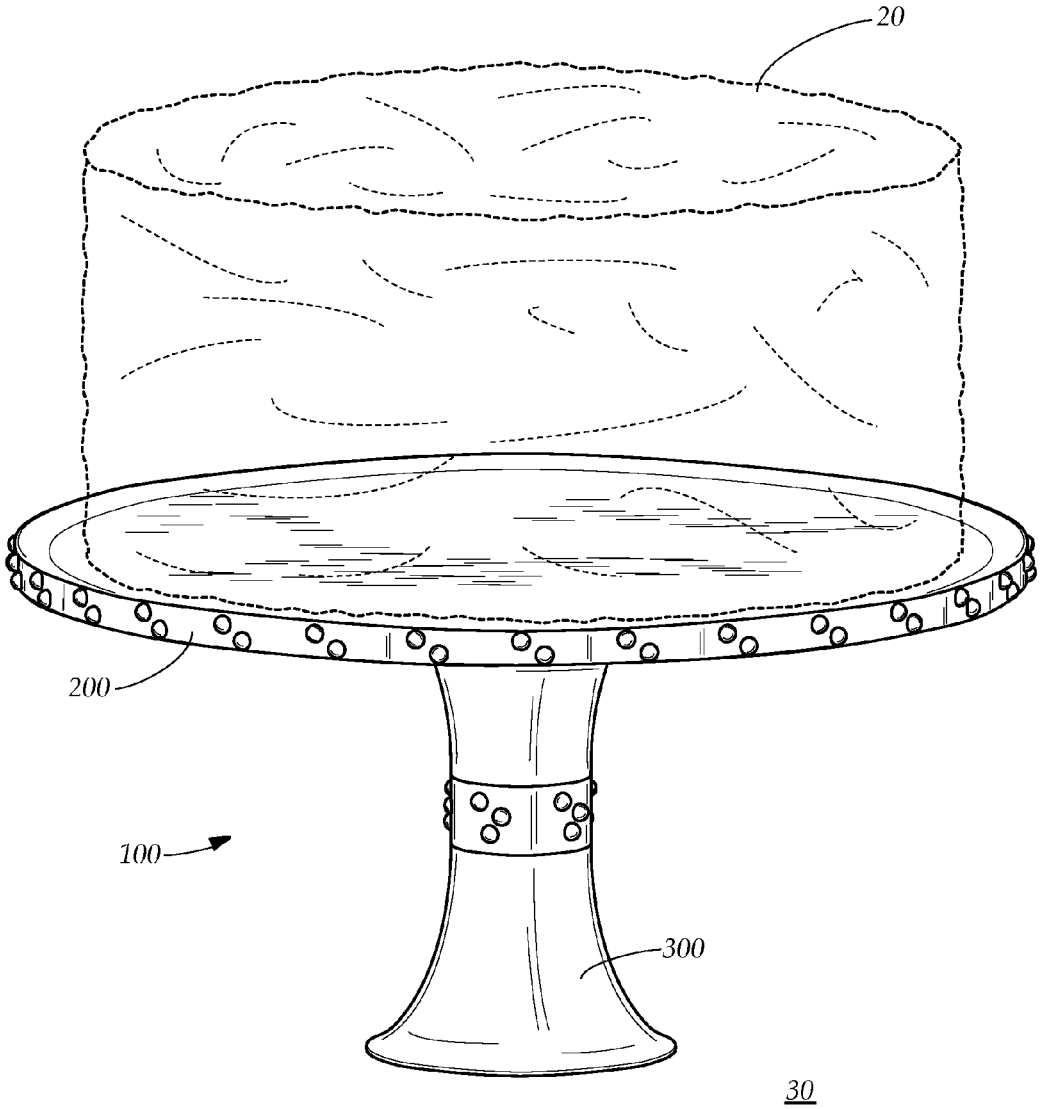
FIG. 1 is a diagrammatic perspective view of a invertible tableware system, showing a plate member and a pedestal base member in a pedestal plate configuration, displaying a food item.

FIG. 1 illustrates an aspect of an example embodiment of an invertible tableware system, displaying an item 20 on a tabletop 30. The example embodiment is a pedestal plate 100, having a pedestal base member 300 and a plate member 200 in a first configuration. In the illustration, the item is a food item, namely a cake. However, the example embodiment is not limited to displaying cakes, an other food item, or for example, a party decoration but is unlimited to what can be displayed on the plate member when the pedestal plate of the system is used when setting the table.

Figure 2:
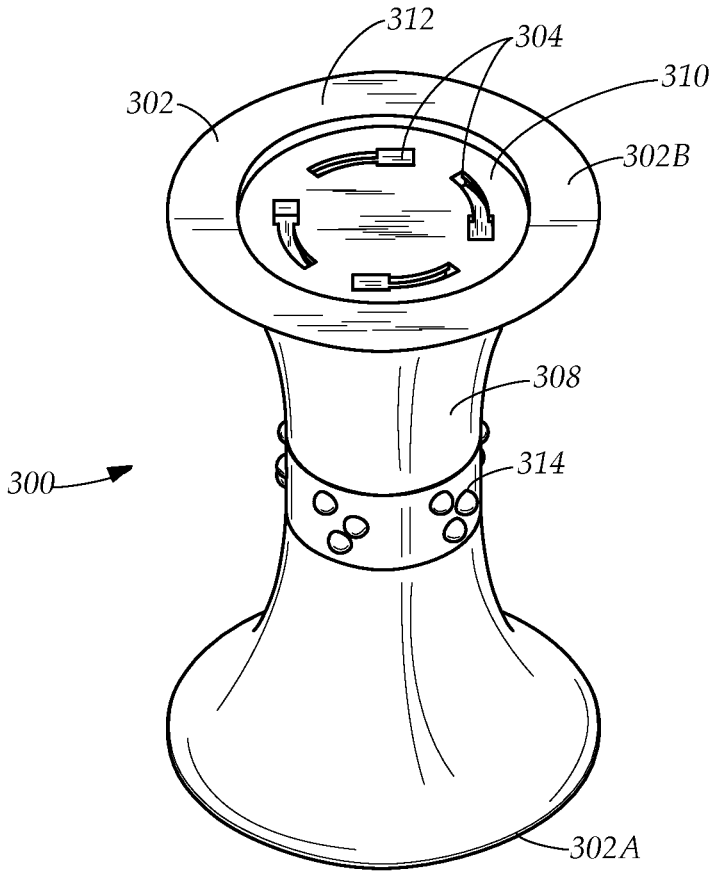
FIG. 2 is a diagrammatic perspective view of the pedestal base member.

FIG. 2 shows the pedestal base member in detail. The base member has a pair of ends 302. In one embodiment, both ends are closed, each closed by a platform 304. In another embodiment, a first end is open 302A and a second end 302B is closed, closed by the platform 304. The platform 304 has an interlocking mechanism to engage other members of the system. In the non-limiting illustration, the interlocking mechanism is a plurality of slots 304 that engage a plurality of tabs on an other member of the system. In the illustrations, the tab and slot mechanism is shown but other mechanisms are possible such as a plurality of magnets, hook and loop fasteners, interlocking ridges, as non-limiting examples, and are possible within the inventive concept.

The base member 300 has a body 308 connecting the two ends 302. The body can have a decorative trim 314. The shape of the body is not a limitation and a straight cylinder, as well as a shape tapering away from the ends, is all possible within the inventive concept. If the base member has an open end 302B, the base member inverts operative as a vase when the open end is topmost.

The base member 300 optionally has a lip 312 around the platform, forming a structure for securing a decorative item such as a candle. If the closed end 302B with the platform 310 is topmost, the base member inverts from the vase to a candle holder as explained hereinbelow.

Figure 3:
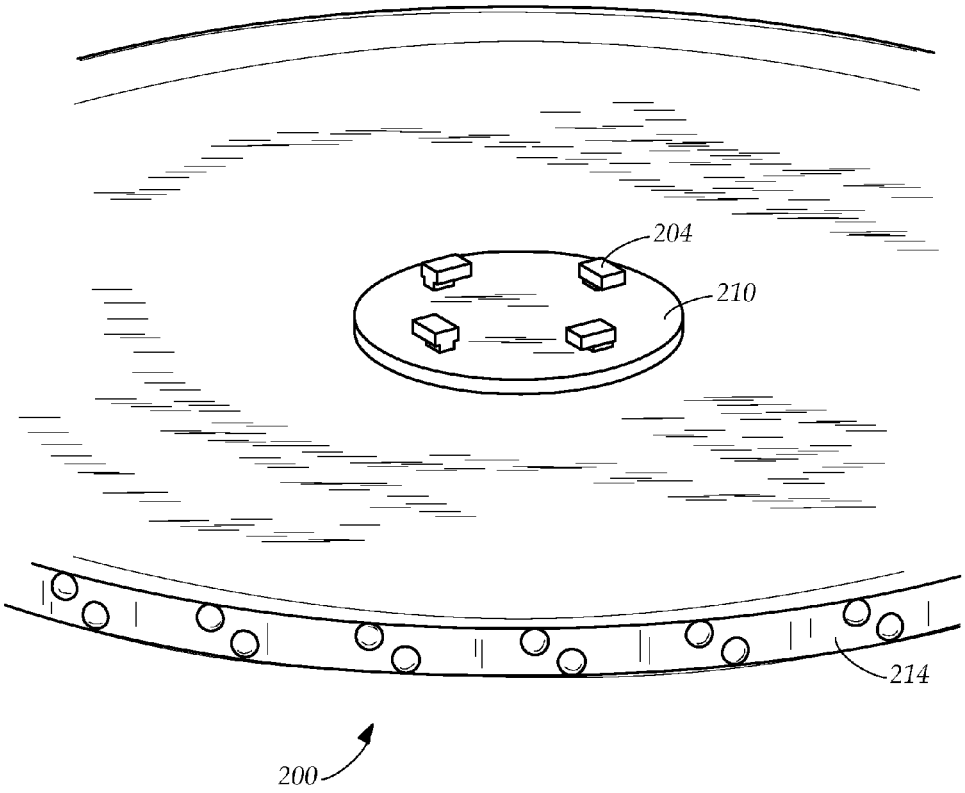
FIG. 3 is a perspective view of a center portion of a plate member.

FIG. 3 shows the plate member 200 with a center portion 210 having a plurality of tabs 204. In the embodiment discussed hereinabove, the base member has a center portion with an interlocking mechanism. In the non-limiting illustration, the center portion has tabs 204 that fit into the slots of the base member as previously discussed. Other interlocking mechanisms are possible as previously explained. In one embodiment, the front and back are same, each having a center portion. In a further embodiment, the back has the center portion, the front devoid of the center portion but the same in all other aspects.

FIG. 3 shows a rim 214 with a decorative trim. In a further embodiment, the trim is a raised edge that interlocks when a plurality of plate members are stacked, a first plate member on a second plate member, making a compact stack.

Figure 5:
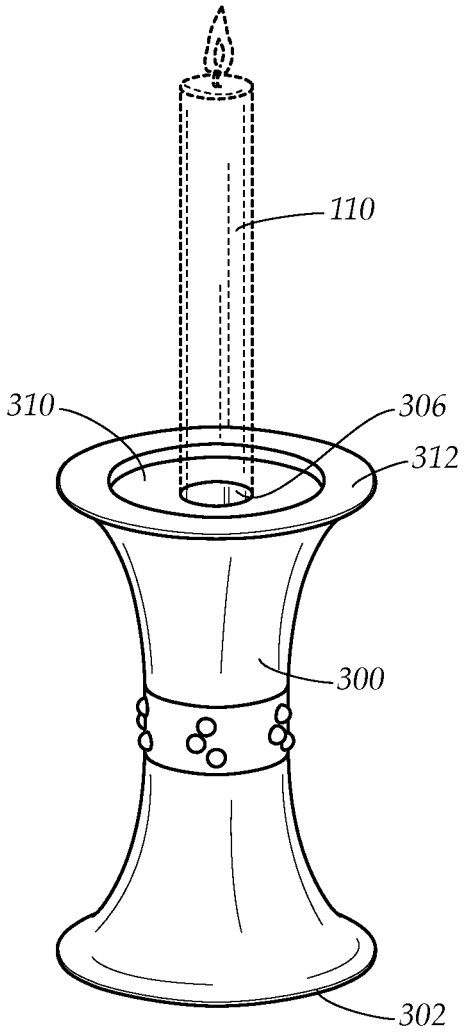
FIG. 5 is an perspective view of the base member displaying a candle.

FIG. 5 shows the base member 300 operative as a candle holder. In one embodiment, the platform 310 has a hollow 306 for fitting a taper 110. The platform 310 is operative for fitting a pillar candle within the lip 312. In a further embodiment, the end of the base member 300 has the interlocking mechanism, the base member selectively engaging a plate member operative to catch any drips from the candle 110.

Figure 4:
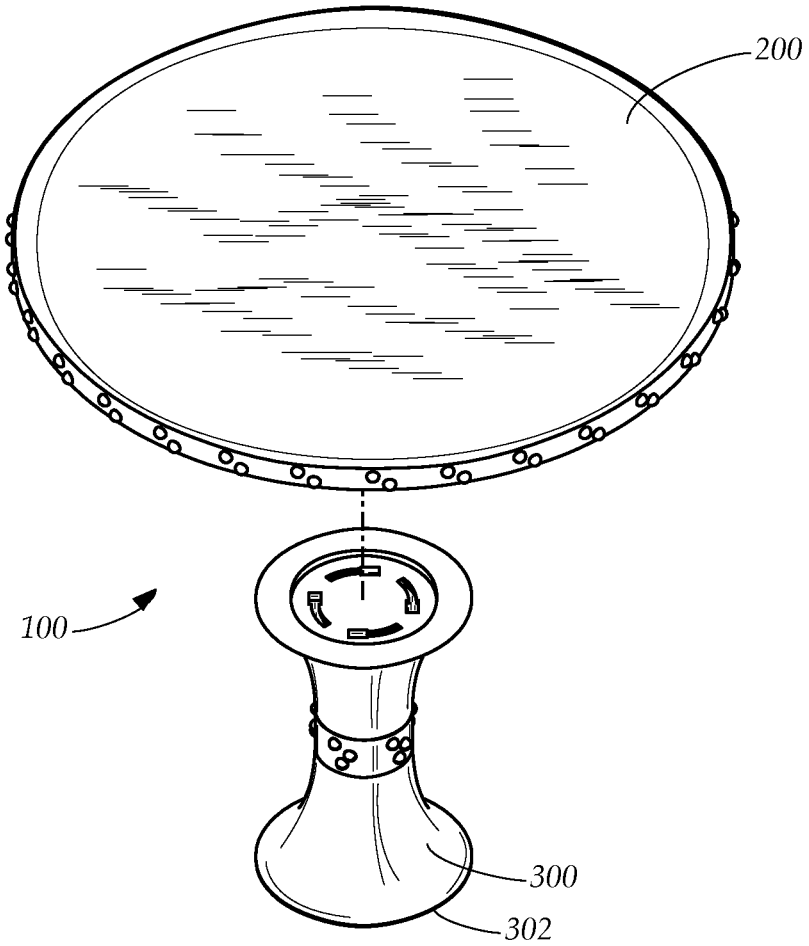
FIG. 4 is an exploded perspective view of the plate member engaging the pedestal base member in the pedestal plate configuration.

FIG. 4 shows the plate member 200 engaging the base member 300, forming the pedestal plate 100 as a first configuration. In one embodiment, the pedestal plate inverts, and the candle is placed on the base member end 302 in a second configuration. In one embodiment, the end 302 is open and the pedestal plate inverts operative as a vase with a protective plate member operative as a coaster. It is understood by those of ordinary skill that the interlocking mechanism between the two members is liquid-tight when the base is operative as the vase.

Figure 6:
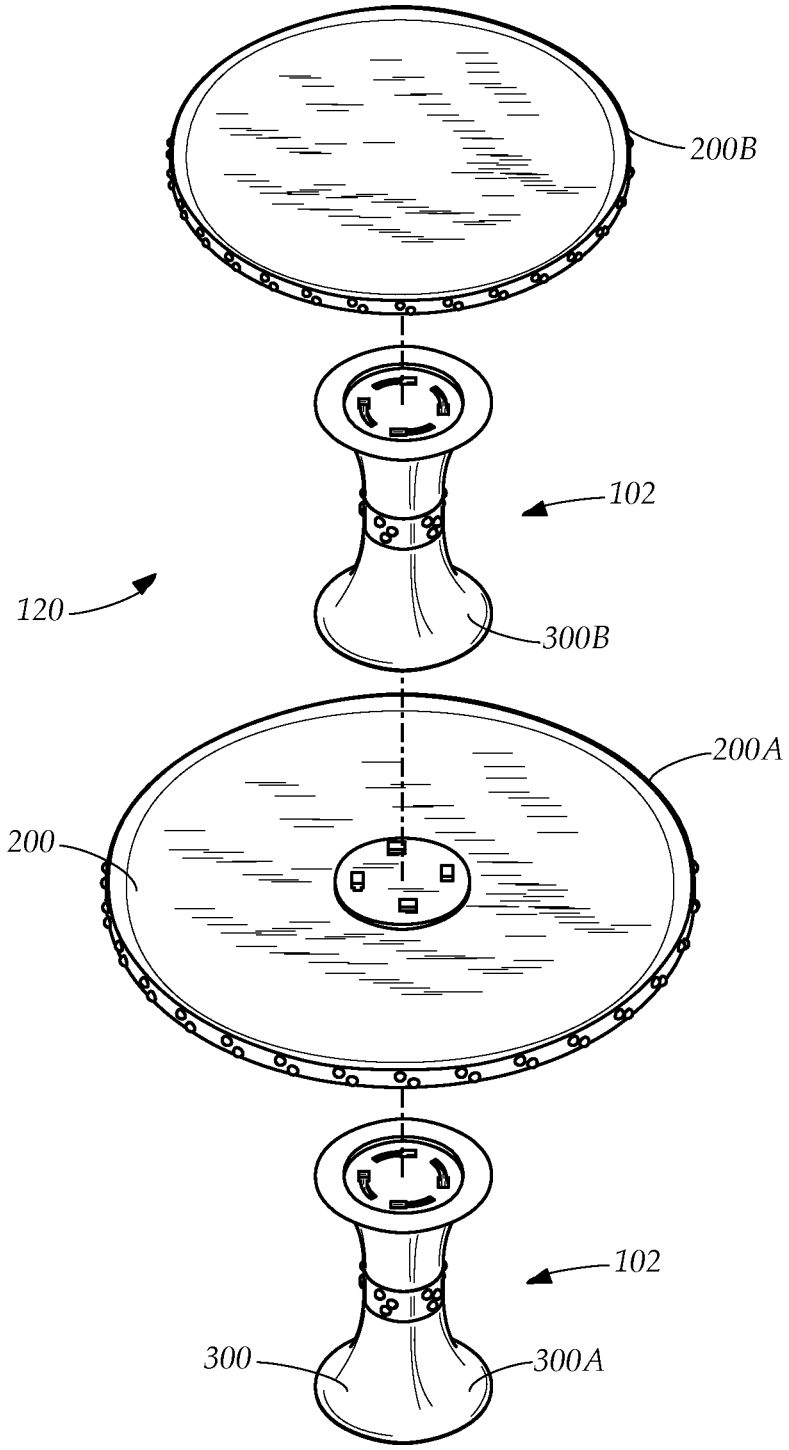
FIG. 6 is an exploded perspective view of a plurality of members forming a tiered pedestal plate.

FIG. 6 illustrates a plurality of base members 300 engaging a plurality of plate members in a stacking configuration forming a plurality of pairs 102, a plate member pair 102 each having the base member 300 and the plate member 200, a first base member 300A engaging a first plate member 200A, a next base member 300B standing on the first plate member 200A, the next base member engaging a next plate member 200B, the stacking continuing, alternating base member 300 with plate member 200, forming a tiered pedestal plate 120. In one embodiment, the next plate member 200B is smaller in diameter than the first plate member 200A, the next plate member stacking above the first plate member, forming a tapering tiered pedestal plate 120 as demonstrated in FIG. 7.

Figure 7:
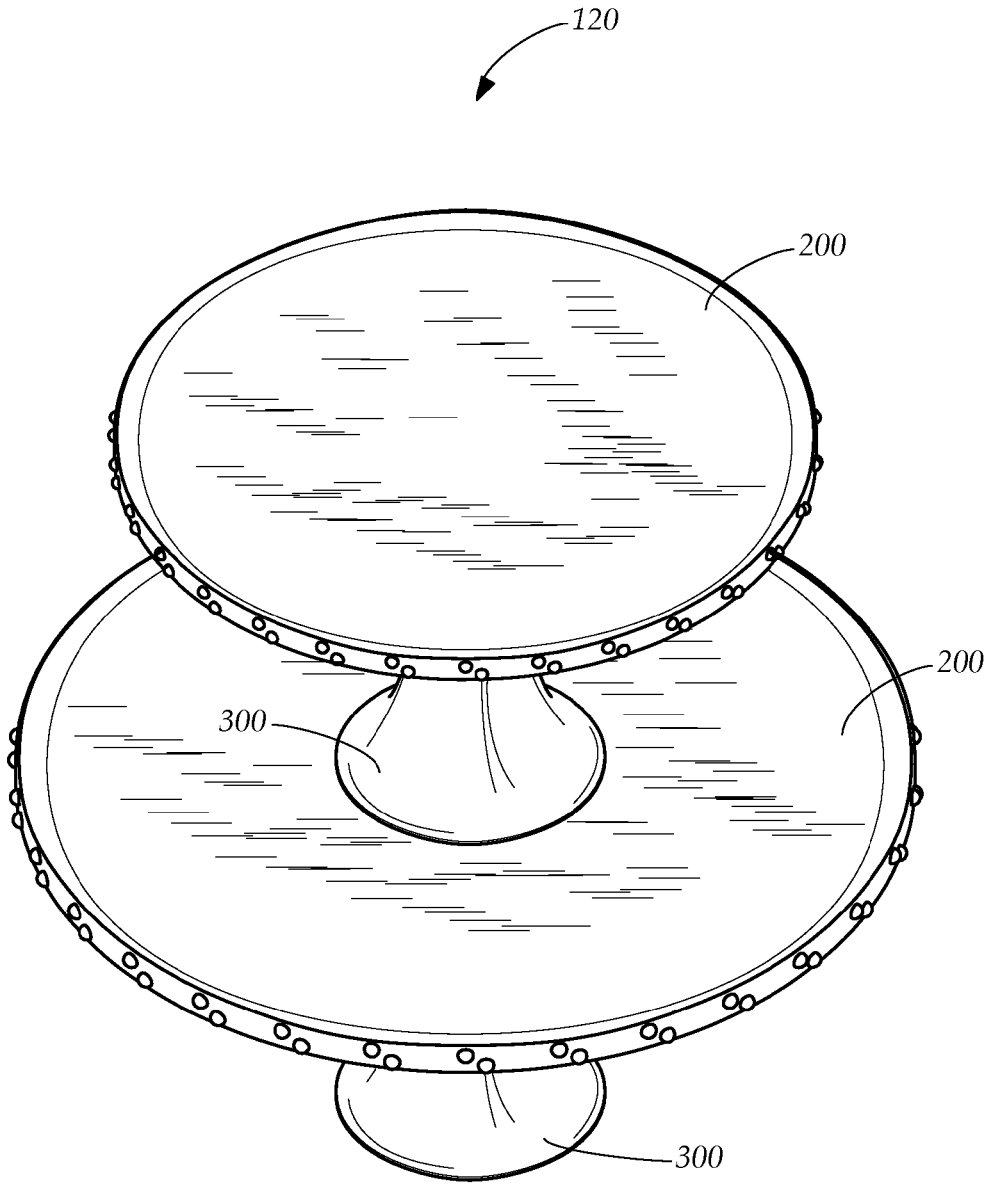
FIG. 7 is a perspective view of a tiered pedestal plate.

In FIG. 7, items such as decorations and food are placed on the plate members, surrounding the pedestal base members. The illustration shows two pairs of members, but it is understood by those of ordinary skill that this is not a limitation and that tiered pedestal plates of various configurations are possible within the inventive concept.

Figure 8:
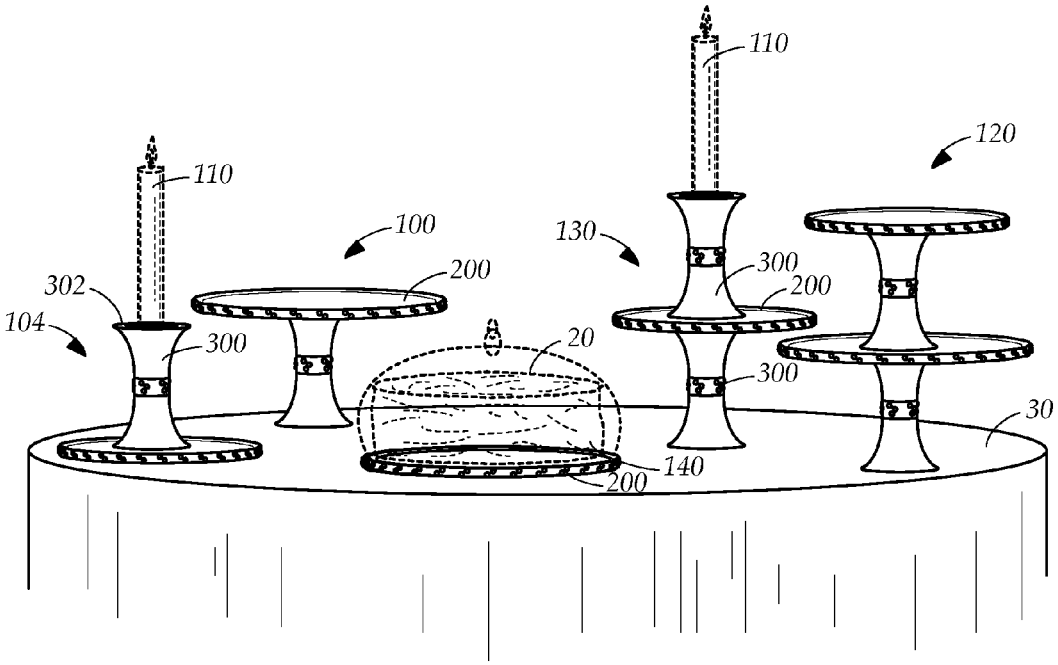
FIG. 8 is a perspective view of a tabletop displaying a plurality of configurations operable within the tableware system.

FIG. 8 shows the system on a buffet table 30. Describing from left to right: an inverted pedestal plate 104 showing the pedestal base 300 operative as a candle holder with a taper 110 on the closed end 302 of the base; the pedestal plate 100, with the plate member 200 operative for displaying the item such as food or decoration; a plate member 200 with a bell dome 20 over the food item 20, the plate member operative absent a base member; a tiered candle holder 130, the tiered candle holder have a pair of base members 300 engaging a plate member 200 therebetween; and the tiered pedestal plate 120.

Not shown in the drawing but included in one embodiment is the inverted base member with the open end operative as a vase. Also not shown in the drawing is a pair of base members each having one end engaged with the other, engaging in a stacking configuration, a first base member engaging a second base member forming a tall candle holder for a pillar candle. The plurality of configurations all possible using only two forms in the system, the plate member and the pedestal base member, that operative in the inverted position as well as the non-inverted position.

In another embodiment, the plate member with the bell dome inverts operative as a covered bowl for items such as salad or punch.

Figure 10:
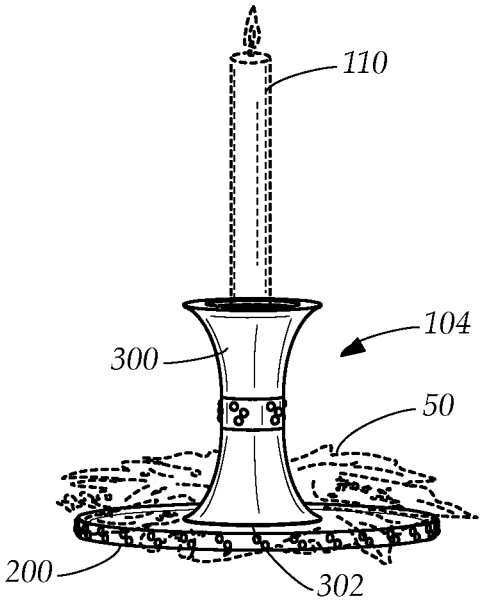
FIG. 10 is a perspective view of a centerpiece, the base member operative as a candle holder, standing on a plate, with a decorative item surrounding the base.

FIG. 10 shows yet another embodiment of the system. The pedestal base member operative as a candle holder 104 with a taper 110 on the end 302 of the base engaging the plate member 200. The base member 300 is surrounded by a decorative item 50, such as holly, flowers or other seasonal trim, the decorative item on the plate member, the candle holder with the decorative item operative as a centerpiece. Not illustrated is other embodiments such as the pair of tiered candle holder described hereabove as well as the tiered pedestal plate and an inverted tiered pedestal plate are trimmable with the decorative item on the plate member. The embodiments of decorative items trimming the members coordinates table appearance by matching the other tableware members operative for serving and dining on the table.

Figure 11:
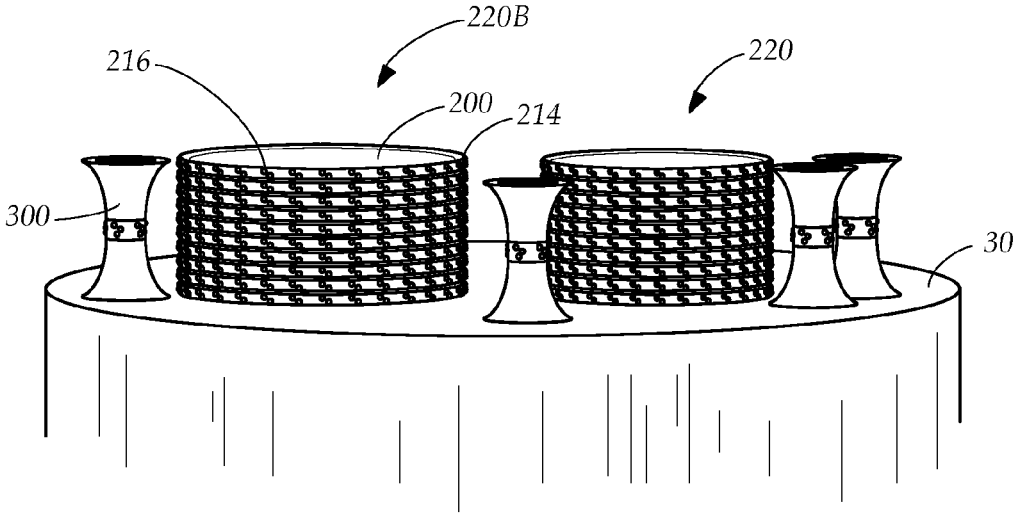
FIG. 11 is a perspective of the tabletop displaying a plurality of pedestal base members and a plurality of stacked interlocking plates.

FIG. 11 show a multiplicity of plate members compactly stacking on the table 30 in one embodiment. The plate members 200 have an interlocking edge 216 on the rim 214, the plate members the same back and front, the plurality of plate members stacking in a compact stack 220, the plate members 200 operative in a first configuration and in an inverted second configuration 220B. The pedestal base members 300 store easily along the compact stack 220.

A user can use the plate members 200 for everyday meals, and the pedestal base members 300 can be used as independent candle holders. The entire collection may be stacked and stored in the same cabinet without taking up a lot of space. Coordinating platters, bowls and serving utensils of varying sizes as well as attachment pieces such as a lazy Susan and a candelabra are possible within the inventive concept.

The pedestals can be made of, for example, but not limited to, stainless steel, silver-plated steel, gold-plated steel, and other suitable materials. All plate members 200 can be the same size and all base members 300 can be the same size as illustrated or the system can have different size plate members and different size base members, such as, two of the six base pedestals measure about four inches high, two measure about eight inches high, one about six inches high, and one about ten and one-half inches high. The six plates can vary in size as well, four measuring about thirteen inches wide and two measuring about ten inches wide. The number, exact size and materials used can vary upon manufacturing and none of these suggested sizes and materials are limitations of the inventive concept but are for illustrative purposes.

Figure 9A:
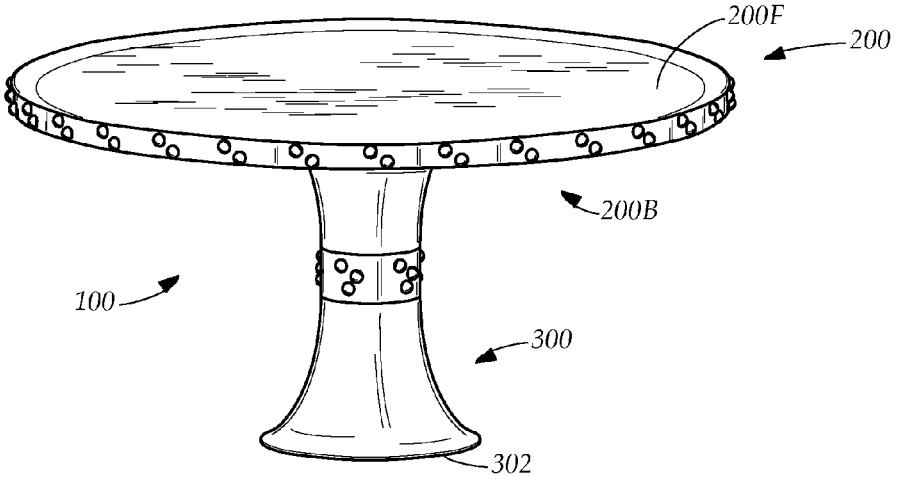
FIG. 9A is a perspective view of the plate member engaging the pedestal base member in the pedestal plate configuration.
Figure 9B:
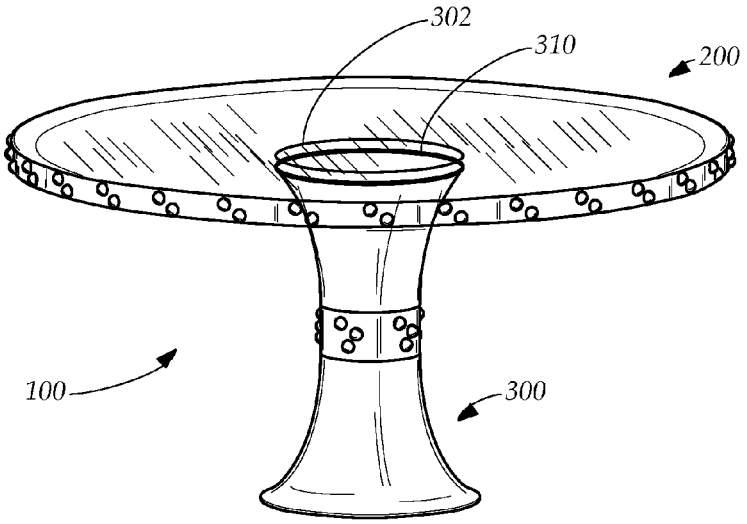
FIG. 9B, similar to FIG. 9*a*, is a perspective view of the pedestal plate configuration, showing the plate member engaging the pedestal base member.

Referring to FIG. 9A and FIG. 9B, a method for setting a table using an invertible tableware system, the system having a plurality of plate members and pedestal base members, comprises engaging at least one plate member 200, the plate member having a back 200B and a front 200F, the back having a center portion 310, the center portion having an interlocking mechanism with at least one pedestal base member 300, the pedestal base member having a closed end 302 with a platform, the platform having an interlocking mechanism, the pair of members engaged in a first configuration operative 100 for displaying a first item and inverting the engaged members operative in a second configuration, the second configuration an inversion of the first configuration, the second configuration operative for displaying a second item.

The engaged plate member and base member form a first engaged pair and a next plate member engages with a next base member forming a next engaged pair and the first engaged pair are stacked on the next engaged pair, forming a tiered pedestal displaying a plurality of items. The pedestal bases have the second closed end, 302 and the second closed end of the next base member engages with the first plate member locking the tiered pedestal for stability. The tiered pedestal inverts, operative for displaying a plurality of second items.

The method for setting a table includes the step of placing the base member on top of the plate member operative for holding a candle and placing a decorative item around the base member on the plate member as shown in FIG. 10 and described hereinabove.

The system provides a wide variety of decorating options when displaying large amounts of food and other items in a small space. The system preferably contains thirteen members, including six pedestal base members and six plate members and optionally a bell dome member. The plate members are designed to look the same from the front or the back. The back of each plate member has a center portion with an interlocking mechanism and in one embodiment, the front of each plate member has an interlocking mechanism where each pedestal base member locks securely into place. The plate member in a first configuration as pedestal plate displays items, or inverted, the pedestal base member is operative as a candle holder, fitting tapers and pillar candles, the pedestal base member selectively standing on a plate member. The plate members selectively disengage from the base members for easy storage and use all year round. This system benefits virtually any host or hostess needing multiple display options on a small tabletop when entertaining.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a invertible tableware system for displaying an item on a tabletop. The disclosure is illustrated by example in the drawing figures, and throughout the written description. It should be understood that numerous variations are possible, while adhering to the inventive concept. Such variations are contemplated as being a part of the present disclosure.

What is claimed is:

1. An invertible tableware system for displaying a plurality of items on a tabletop, comprising:

at least one plate member, the plate member having a back and a front, the back having a center portion, the center portion having an interlocking mechanism;

at least one pedestal base member, the pedestal base member having a pair of open ends, the pedestal base member substantially cylindrical; and a platform, the platform having an interlocking mechanism, the platform disposed on an end of the at least one pedestal base member, the platform closing said end of the at least one pedestal base member, the interlocking mechanism of the platform selectively engaging the interlocking mechanism of the at least one plate member, the at least one plate member and the at least one pedestal base member forming a pair of engaged members, the engaged members operative in a first configuration, the first configuration having the at least one plate member disposed atop the at least one pedestal base member, displaying a first item, the first item disposed atop the front of the at least one plate member, the pair of engaged members operative in a second configuration, the second configuration an inversion of the first configuration, the second configuration having the at least one pedestal base member disposed atop the at least one plate member, the at least one pedestal base member having an open end, the open end of the at least one pedestal base member at a top of said second configuration, said open end of the at least one pedestal base member operative for inserting a second item, the second item disposed within the at least one pedestal base member, the second item extending upwards from said open end of the at least one pedestal base member, the second configuration operative for displaying the second item.

2. The invertible tableware system as described in claim 1, wherein a plurality of pairs of engaged members, each pair having at least one plate member engaging at least one pedestal base member are stacked, a first pair of engaged members disposed atop a second pair of engaged members, forming a tiered pedestal plate.

3. The invertible tableware system as described in claim 1, wherein the at least one plate member is substantially flat, said plate member having a rim with an interlocking edge, such that when a first plate member is disposed atop a second plate member, said interlocking edge of the first plate member engages said interlocking edge of the second plate member, the interlocking edges on the rims operative for stacking plate members in a compact and secure manner.

4. An invertible tableware system for displaying a plurality of items on a tabletop, comprising:

at least one plate member, the plate member having a back and a front, the front and back each having a center portion;

an interlocking portion disposed on said center portions of said at least one plate member;

at least one pedestal base member, the pedestal base member having a pair of ends; and a pair of platforms, each platform having an interlocking mechanism, one platform disposed on each end of the at least one pedestal base member, said platform closing said end of the at least one pedestal base member, the interlocking mechanism of said platform selectively engaging the interlocking portion of the at least on plate member, the at least one plate member and the at least one pedestal base member forming a pair of engaged members, the pair of engaged members operative in a first configuration having the at least one plate member disposed atop of the at least one pedestal base member, displaying a first item disposed atop the front of the at least one plate member, the pair of engaged members operative in a second configuration, the second configuration an inversion of the first configuration, the second configuration having the at least one pedestal base member disposed atop the at least one plate member, the pedestal base member having a closed end, the end closed by said platform, said closed end atop said pedestal base member, a second item disposed atop said closed end of the at least one pedestal member, the second configuration operative for displaying a second item.

5. The invertible tableware system as described in claim 4, wherein a pair of pedestal base members having said platform with said interlocking mechanism disposed on the end of said pedestal base members engages the at least one plate member, the at least one plate member having interlocking portions on the center portion of the front of said plate member and the center portion of the back of said plate member, said interlocking mechanism disposed on the end of a first pedestal base member engaging the interlocking portion on the said center portion of the back of the at least one plate member, said interlocking mechanism disposed on the end of a second pedestal base member engaging the interlocking portion on the said center portion of the front of the at least one plate member, one pedestal base member engaging the front of the plate member and one base member engaging the back of the plate member, the pair of pedestal base members having the plate member therebetween.

6. The invertible tableware system as described in claim 4, wherein a plurality of engaged member pairs, the engaged member pairs having one pedestal base member engaging one plate member forming the engaged member pair, each engaged member pair having one interlocking mechanism on the end of the pedestal base member and one interlocking mechanism on the center portion of the plate member, said interlocking mechanism on the pedestal base member of a first pair engaging said interlocking mechanism on the portion on the plate member of a second pair, forming a tiered pedestal plate.

7. A method for setting a table using an invertible tableware system, the system having a plurality of plate members and pedestal base members, comprising:

coupling a platform having an interlocking mechanism to a pedestal base member, the pedestal base member having an open end, the platform coupling to said open end thereby closing said open end;

engaging at least one plate member, the plate member having a back and a front, the back having a center portion, the center portion having an interlocking mechanism, said interlocking mechanism of said plate member engaging atop said platform having said interlocking mechanism coupled to said end of said pedestal base member, the at least one plate member and the at least one pedestal base member forming a pair of engaged members, the engaged members pair operative in a first configuration, the first configuration having the at least one plate member disposed atop the at least one pedestal base member, the first configuration operative for displaying a first item; and inverting said pair of engaged members pair operative forming a second configuration, the second configuration an inversion of the first configuration, the second configuration having the at least one pedestal base member disposed atop the at least one plate member, the pedestal base member having an open end, the open end of the at least one pedestal base member at a top of said second configuration, said open end of the at least one pedestal base member operative for inserting a second item, the second item disposed within the at least one pedestal base member, the second item extending upwards from said open end of the at least one pedestal base member, the second configuration operative for displaying a second item.

8. The method for setting a table as described in claim 7, wherein the engaged plate member and base member form a first engaged pair and the step of engaging at least one plate member with at least one base member is followed by the step of:

engaging a next plate member with a next base member forming a next engaged pair; and stacking the first engaged pair on the next engaged pair, forming a tiered pedestal displaying a plurality of items.

* * * * *